US007956270B1

(12) United States Patent
Burmeister et al.

(10) Patent No.: US 7,956,270 B1
(45) Date of Patent: Jun. 7, 2011

(54) SELF-CLOSING HOODED COVER FOR A STRINGED MUSICAL INSTRUMENT

(76) Inventors: Patricia M. Burmeister, Northbrook, IL (US); Allen R. Burmeister, Northbrook, IL (US)

( * ) Notice: Subject to any disclaimer, the term of this patent is extended or adjusted under 35 U.S.C. 154(b) by 0 days.

(21) Appl. No.: 12/567,719

(22) Filed: Sep. 25, 2009

Related U.S. Application Data

(60) Provisional application No. 61/100,086, filed on Sep. 25, 2008.

(51) Int. Cl.
*G10D 9/00* (2006.01)

(52) U.S. Cl. ..... 84/453

(58) Field of Classification Search ..... 84/453
See application file for complete search history.

(56) References Cited

U.S. PATENT DOCUMENTS

| | | | | | |
|---|---|---|---|---|---|
| 2,175,327 | A | * | 10/1939 | Thornhill et al. | 150/129 |
| 2,319,292 | A | * | 5/1943 | Boggs | 2/96 |
| 2,397,931 | A | * | 4/1946 | Ellis | 24/303 |
| 2,627,097 | A | * | 2/1953 | Ellis | 24/303 |
| D169,352 | S | * | 4/1953 | Boyd | D2/823 |
| 2,986,743 | A | * | 6/1961 | Eilen | 40/586 |
| 3,102,314 | A | * | 9/1963 | Alderfer | 24/303 |
| D204,225 | S | * | 4/1966 | Klein | D2/825 |
| 3,258,781 | A | * | 7/1966 | Klein | 2/88 |
| 3,275,128 | A | * | 9/1966 | Neely | 206/281 |
| D229,653 | S | * | 12/1973 | Henderson | D6/610 |
| 3,827,019 | A | * | 7/1974 | Serbu | 335/285 |
| D232,497 | S | * | 8/1974 | Busse | D2/825 |
| 4,928,321 | A | * | 5/1990 | Dobson | 2/84 |
| D380,292 | S | * | 7/1997 | Funk | D3/204 |
| 5,875,890 | A | * | 3/1999 | Di Bernardini | 206/314 |
| 6,301,754 | B1 | * | 10/2001 | Grunberger et al. | 24/303 |
| 6,434,801 | B2 | * | 8/2002 | Grunberger | 24/303 |
| 6,441,288 | B1 | * | 8/2002 | Lin | 84/453 |
| D463,103 | S | * | 9/2002 | Lin | D3/204 |
| D481,267 | S | * | 10/2003 | Yamane | D7/625 |
| D482,242 | S | * | 11/2003 | Yamane | D7/625 |
| 6,643,847 | B1 | * | 11/2003 | Dornak | 2/195.1 |
| 6,723,906 | B2 | * | 4/2004 | Bourgoin | 84/411 R |
| D499,309 | S | * | 12/2004 | Hicks | D7/625 |
| D523,633 | S | * | 6/2006 | Arnold | D3/271.4 |
| 7,065,841 | B2 | * | 6/2006 | Sjoquist | 24/303 |
| D531,407 | S | * | 11/2006 | Montague | D3/290 |
| 7,291,778 | B2 | * | 11/2007 | Larry | 84/453 |
| 7,357,219 | B2 | * | 4/2008 | Mafi et al. | 181/202 |
| 7,454,856 | B2 | * | 11/2008 | Passman | 40/661.04 |
| D584,046 | S | * | 1/2009 | Montague | D3/243 |
| D609,461 | S | * | 2/2010 | Boyd | D3/218 |

(Continued)

*Primary Examiner* — Elvin G Enad
*Assistant Examiner* — Robert W Horn
(74) *Attorney, Agent, or Firm* — Raymond N. Ervin, Ltd.

(57) ABSTRACT

The present invention specifically relates to a SELF-CLOSING HOODED COVER FOR A STRINGED MUSICAL INSTRUMENT that is specifically designed to protect a stringed musical instrument from the deleterious effects of dust and debris in addition to providing protection to the instrument's finish from scratches and minor low velocity impacts. The self-closing hooded cover for a stringed instrument may comprise a fabric panel having a contour that loosely approximates the given musical instrument of symmetrical construction, which has a hood and a body element having a self-closing closure about the front midline and bottom. The invention further provides additional protection from the damaging effects of exposure from sunlight, and exposure to harsh environmental elements wherein instances for such exposure may exist. In another embodiment the self-closing hooded cover may be converted to a bag or case cover. Additional embodiments providing differing arrangements of the primary elements are also disclosed.

13 Claims, 3 Drawing Sheets

U.S. PATENT DOCUMENTS

| | | | | |
|---|---|---|---|---|
| 7,671,264 | B1 * | 3/2010 | Heda | 84/453 |
| 7,740,314 | B2 * | 6/2010 | Friedland et al. | 297/219.12 |
| D634,539 | S * | 3/2011 | Burmeister et al. | D3/204 |
| 2002/0189423 | A1 * | 12/2002 | Brantley | 84/453 |
| 2006/0143774 | A1 * | 7/2006 | Walsh et al. | 2/94 |
| 2007/0221693 | A1 * | 9/2007 | Moore | 224/148.6 |
| 2008/0216633 | A1 * | 9/2008 | Winch | 84/329 |
| 2008/0276513 | A1 * | 11/2008 | Jose et al. | 40/654.01 |
| 2009/0178245 | A1 * | 7/2009 | Albert | 24/303 |

* cited by examiner

SELF-CLOSING HOODED COVER FOR A STRINGED MUSICAL INSTRUMENT

CLAIM FOR PRIORITY OF INVENTION

This application claims the benefit of U.S. Provisional Application Ser. No. 61/100,086, Hooded Cover for a Stringed Instrument, filed 25 Sep. 2008, presently abandoned, in accordance with 35 USC §119 (e).

CROSS-REFERENCE TO RELATED APPLICATIONS

This application claims the benefit of U.S. Non-Provisional Design patent application Ser. No. 29/343,837, Self-Closing Hooded Cover for a Stringed Musical Instrument, filed 20 Sep. 2009, presently scheduled to issue 22 Mar. 2011 as U.S. Patent D634,539, in accordance with 35 USC §120, and U.S. Provisional Application Ser. No. 61/100,086, Hooded Cover for a Stringed Instrument, filed 25 Sep. 2008, presently abandoned, in accordance with 35 USC §§119 (e), 120 wherein the respective disclosures of which are hereby incorporated by reference herein.

FEDERALLY SPONSORED RESEARCH OR DEVELOPMENT

There has been no research or development sponsored in whole or part by the Federal government or any agency thereof in respect to the instant invention.

BACKGROUND OF THE INVENTION

1. Field of the Invention

The present invention specifically relates to a SELF-CLOSING HOODED COVER FOR A STRINGED MUSICAL INSTRUMENT (hereafter referred to as the self-closing hooded cover), which has the capabilities for providing protection to various stringed instruments from the deleterious effects of dust and debris, in addition to providing protection to the instrument's finish from scratches and minor impacts. The invention further provides additional protection from the damaging effects of exposure to infrared (IR) and ultraviolet (UV) radiation from sunlight, and exposure to harsh environmental elements when the instrument is employed in outdoor settings i.e. amphitheatres, stadiums or open halls wherein instances for such exposure may exist. An embodiment of the invention provides for the opportunity for a performer or group to promote themselves by inserting a user customized graphic message into a pouch on the front of the self-closing hooded cover. In another embodiment the self-closing hooded cover may be converted to a lightweight carrying bag or case cover to also provide a convenient means of transporting the self-closing hooded cover for a musical instrument, while simultaneously providing an additional element of protection to the stringed musical instrument and/or its case. A method whereby an individual user may facilitate the routine use of the self-closing hooded cover is also disclosed.

2. Description of the Related Art

An effective means for protecting stringed musical instruments when they are not enclosed in their case or in use from various environmental effects such as dust and debris from settling upon them, the effects of exposure to infrared (IR) and ultraviolet (UV) radiation from sunlight and the consequences of moisture and temperature that may be encountered in outdoor amphitheatres have long been sought. The deleterious effects of dust have ranged from minor nuisances such as requiring the musician to spend time to clean the instrument before playing it; to the more severe instances wherein the dust may interfere with the ability of electric pickups to perform properly. The typical means of addressing this issue is to place the instrument in its case, where it may enjoy the benefits of an environment that shields the instrument from dust, debris, moisture, light radiation and impact damage (in the case of rigid (hard shell) cases). However, the downside of this approach is that it requires a more concerted effort to be manifested on behalf of the musician to retrieve the instrument from this domain and set it up. In other words, cases present the paradox of representing the maximum of protection for the instrument, while simultaneously presenting a minimum of accessibility and a maximum inconvenience. Further, the use of a case in these instances does not accord well with the spontaneity that is an elemental aspect of a musician's nature. Hence, an instrument tends to be played more when it is readily available and can be left on its stand at the constant ready to serve an individual's beckon call. As such, there have been numerous attempts to provide the benefits extolled by cases over the years with mixed results based both on their acceptance by users and their ability to truly make the instrument more available while offering some minimum level of protection. These attempts have run the gamut from the relatively simple to the more involved, respective examples are expressed by the Drapester®[3] and U.S. Pat. No. 6,441,288 B1, Guitar Cover for Protecting Guitar Supported on Guitar Stand, by Eddie Fong Cheung Lin, ('288 Patent'), which is marketed as TUKI Covers®[4]. The Drapester® is merely a swath of fabric of a predetermined size and geometry which is proportional to the instrument to be covered that is merely draped over the stringed instrument while it is on its stand. The Drapester® does not provide a contoured fit to the instrument and leaves a great deal of the instrument exposed. The Drapester® only serves to limit the settling of dust and debris that may be deposited upon the instrument in a vertical plane to the instrument, and does little to provide protection from those environmental factors that do not impinge the Drapester® in a normal plane. The Drapester® also does not provide an adequate enclosure for the instrument against accidental low velocity impacts as the instrument is only partially covered and the Drapester® does not maintain its positional relationship to the instrument in instances wherein the instrument would be displaced from its stand. This is due to the fact that the Drapester® is maintained in its position on the stringed instrument by counterbalancing its weight, which is achieved by draping a length of the fabric over the scroll or head of the instrument, such that the weight equals that of the fabric on the front of the instrument offset by the tangent of the stand. It should also be noted that as the angle of the stand approaches 90° (normal) that the size of the Drapester® increases to satisfy the requirements to adequately cover the instrument and maintain its position using this counterbalancing approach.

[3] Drapester® is a registered trademark of GekkoTek, LLC 241 N. Clark Avenue, Los Altos, Calif. 94022

[4] TUKI Covers® is the registered trademark of TUKI International, Inc. 5060 Coosaw Creek Blvd. N., Charleston, N.C. 29420

The '288 Patent' by Lin (hereafter the TUKI Cover®) overcomes a number of the shortfalls presented by the Drapester® by providing a tubular cover having a zippered slit about the backside to accommodate the appurtenances of the stand, a zipper to join the two front sides together and a hood formed by closing flaps about the topmost portion of the cover with snap-hook closures. The TUKI Cover® while it provides for a more contoured fit still does not completely eliminate the exposure of the stringed instrument to environmental elements as there exists no closed bottom and the back features a zippered slot. The zippered slot serves to allow a user to close the slot about the musical instrument stand, which serves to aid in securing the TUKI Cover® on the stand, while closing a portion of the slot. This does act to reduce some of the environmental exposure; however the exposure is directly proportional to the distance between the support arms of the instrument stand. The TUKI Cover® also requires greater effort and more attention to detail to employ than the Drapester®, which requires a negligible effort to use.

Also both the Drapester® and TUKI Cover® both require that they be stowed and transported separately from the stringed instrument. This dictates that most musicians will have to attend to an additional piece of gear that must be transported and handled over the course of their engagements.

Given the multitude of shortcomings and disadvantages regarding the existing approaches to protecting a string instrument from dust and other environmental elements it would be desirable to have an affordable and convenient solution within the grasp of the average consumer of this commodity that could allow the stringed instrument to be completely covered by a cover that would employ a minimum of effort, while offering additional low velocity impact protection and having a convenient means of transporting the cover from various engagements. The present invention satisfies such a need.

SUMMARY OF THE INVENTION

The present invention specifically relates to a SELF-CLOSING HOODED COVER FOR A STRINGED MUSICAL INSTRUMENT that is specifically designed to protect a stringed musical instrument from the deleterious effects of dust and debris in addition to providing protection to the instrument's finish from scratches and minor low velocity impacts. The self-closing hooded cover for a stringed instrument may comprise a fabric panel having a contour that loosely approximates the given musical instrument, having a front side, rear side, first side, second side, top side and bottom side and being of symmetrical construction, which has a hood and a body element having a self-closing closure about the front midline and bottom that may be sealed by engaging one or more closure fasteners. The invention further provides additional protection from the damaging effects of exposure to infrared (IR) and ultraviolet (UV) radiation from sunlight, and exposure to harsh environmental elements when the instrument is employed in an outdoor setting i.e. amphitheatres, stadiums or open halls wherein instances for such exposure may exist. An embodiment of the invention provides for the opportunity for a performer or group to promote themselves by inserting a user customized graphic message into a pouch on the front of the self-closing hooded cover. In another embodiment the self-closing hooded cover for a stringed instrument may comprise an internal pouch, which may accommodate the musician's sheet music or gear. In another embodiment the self-closing hooded cover may be converted to a bag or case cover, wherein the self-closing hooded cover may also be conveniently transported in addition to providing additional protection to the stringed musical instrument and/or its case.

The proposed method of use of the self-closing hooded cover for stringed musical instrument may consist of the following sequence wherein an individual user or musician (typ.) desires to cover the instrument that is resting on a stand:

6. The musician removes the self-closing hooded cover for a stringed instrument from its stowed position and unfolds and extends the hooded cover to its full length.
7. The musician then opens the self-closing hooded cover for a stringed instrument by disengaging the closure fasteners from the first and second side closure seams traversing the entire midline and bottom side of the hooded cover.
8. The musician then drapes the self-closing hooded cover for a stringed instrument over the head (or scroll) of the stringed instrument, wherein the first and second side closure seams are in approximate positional agreement with the midline of the front side of the instrument. In the instance where the stringed instrument is to be hung from a wall hanger, the musician then drapes the self-closing hooded cover for a stringed instrument over the head (or scroll) of the stringed instrument, wherein the first and second side closure seams are in approximate positional agreement with the midline of the back side of the instrument.
9. The musician then grasps the bottom front of the first and second side closure seams and tensionably aligns the closure fasteners located in the bottom front closure seam with the closure fasteners located in the bottom rear closure seam.
10. The musician may then open the self-closing hooded cover for a stringed instrument to whatever extent desired by opening closure fasteners about the closure seam, separating the first and second closure seams to create an opening of desirable length.

BRIEF DESCRIPTION OF THE DRAWINGS

The Self-Closing Hooded Cover for a Stringed Musical Instrument is reversible about the vertical axis of the musical instrument and may be used with the closure seam and opening in either the front or the back of the stringed musical instrument depending wholly upon the user's individual preference. The following drawings all demonstrate the Self-Closing Hooded Cover for a Stringed Musical Instrument with the closure seam and opening considered as being in the front on the stringed musical instrument.

DETAILED DESCRIPTION OF THE PRESENTLY PREFERRED EMBODIMENTS

Referring to FIGS. 1-4 illustrate the preferred embodiment of a Self-Closing Hooded Cover for a Stringed Musical Instrument, in accordance with the present invention. It should be noted that the Self-Closing Hooded Cover for a Stringed Musical Instrument is reversible about the vertical axis of the stringed musical instrument and may be used with the closure seam and opening in either the front or the back of the stringed musical instrument depending wholly upon the individual user's preference. The following drawings all demonstrate the Self-Closing Hooded Cover for a Stringed Musical Instrument with the closure seam and opening positioned in the front on the stringed musical instrument and subsequently being termed as the front of the Self-Closing Hooded Cover for a Stringed Musical Instrument.

Figure 1:
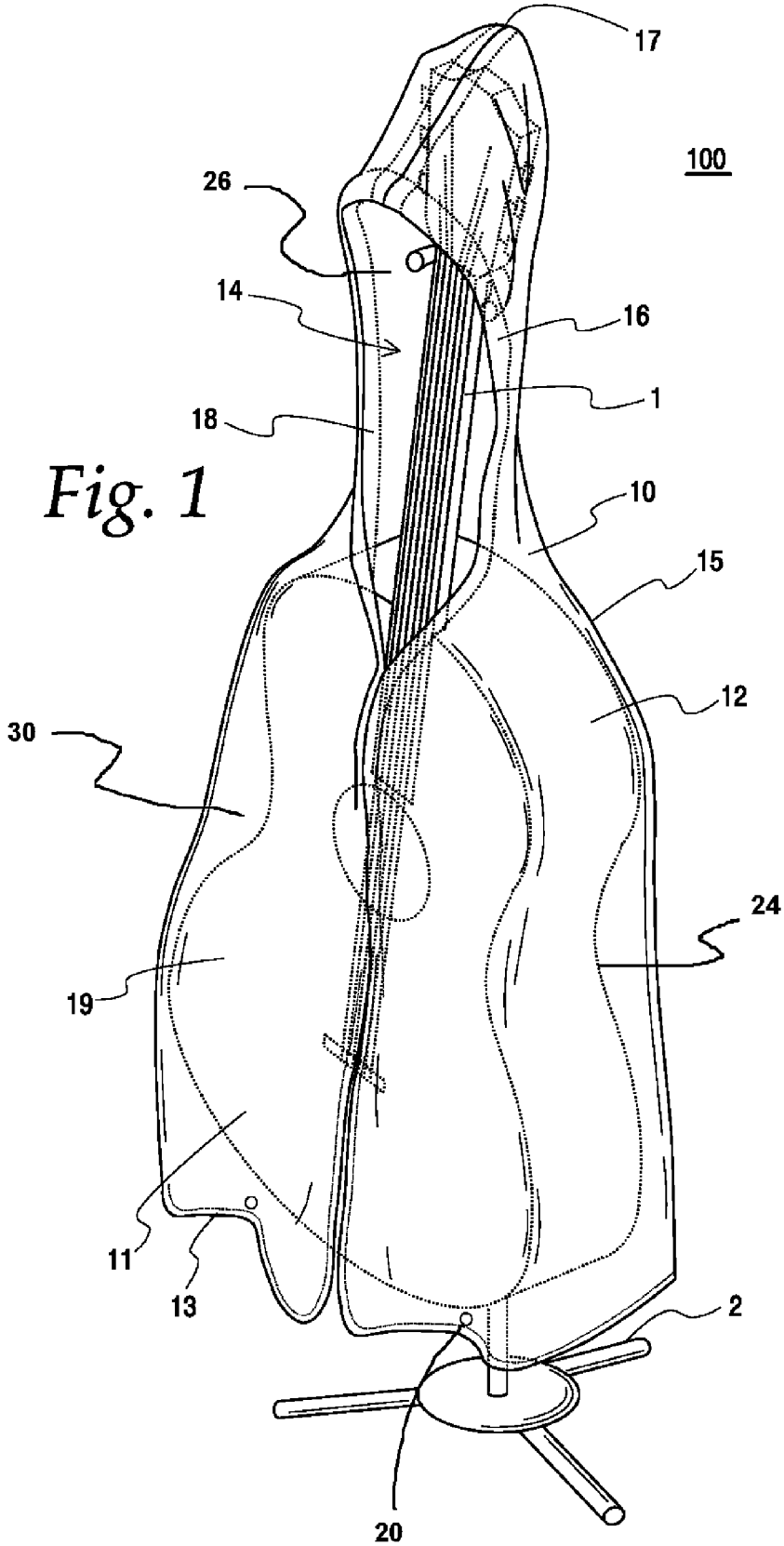
FIG. 1 is a drawing of the Self-Closing Hooded Cover for a Stringed Musical Instrument, showing a front perspective view of the self-closing hooded cover for a stringed musical instrument covering a guitar supported upon an elevated stand, wherein only the hooded portion of the cover is left open to reveal the neck of the guitar.

Referring to FIG. 1, a front perspective view of the present embodiment of the Self-Closing Hooded Cover for a Stringed Musical Instrument is generally shown at 100. The Self-Closing Hooded Cover for a Stringed Musical Instrument 100 may comprise at least one fabric panel 30 that may comprise one or more layers of fabric that may have a predetermined shape and size that permit the fabric panel 30 to substantially envelope a given stringed musical instrument 1 situated upon an instrument stand 2 or hanger, while simultaneously loosely adhering to the contours of the musical instrument 1. The fabric panel 30 may be fashioned to loosely symmetrically contour to the musical instrument 1 by any process known in the Textile Arts such as blocking, forming, sewing, adhesive bonding, heat seaming or ultrasonic welding. In another embodiment the fabric panel 30 may be comprised of one or more pieces of fabric of a predetermined size and shape that upon adjoining by any process known in the Textile Arts such as sewing, weaving, adhesive bonding, heat seaming and ultrasonic welding in a predetermined manner may be fashioned to loosely contour to the musical instrument 1. The fabric panel 30 may be comprised of any fabric known in the Textile Arts such as of acrylic, cotton, polyester, rayon, ramie, nylon, silk, acetate, wool, bamboo, flax, polyester/cotton blends, polyester/cotton/spandex blends, wool/polyester blends, having feathered ends, woven to produce a supple and plush fabric layer that does not pill, lint or harm the finish of the stringed musical instrument 1. Additionally, the material of construction of the fabric panel 30 shall protect the stringed musical instrument 1 from UV and IR light radiation and shall maintain this characteristic in addition to being adequate to endure the hardships of travel, routine handling and cleaning/laundering. The fabric panel 30 may have a first side, a second side, a top side, a bottom side, an interior surface and an exterior surface, which is symmetrically formed to approximate the contours of the musical instrument 1 whereby a joined body element 12 and hood element 14 that loosely envelope the musical instrument 1 may be fabricated. The joined body 12 and hood 14 having a first side 10, a second side 11, each being symmetrical about the vertical midline axis of the Self-Closing Hooded Cover for a Stringed Musical Instrument 100, a top side 17, a bottom side 13, a rear side 15 and a front side 19. The joined body 12 and hood 14 also having an interior surface 24 that is in intimate contact with the musical instrument 1, and exterior surface 26 that addresses the environmental stresses that the unprotected musical instrument 1 would otherwise encounter. The joined body 12 and hood 14 may further comprise a first side closure seam 16 formed by folding a predetermined length of the fabric panel 30 exterior surface 26 over the fabric panel 30 interior surface 24 and joining these surfaces from the midline of the hood top 17 first side to the midline of the body rear side; 22 (FIG. 2) a second side closure seam 18 formed by folding a predetermined length of the fabric panel 30 exterior surface 26 over the fabric panel 30 interior surface 24 and joining these surfaces from the midline of the hood top 17 second side to the midline of the body rear side 22 (FIG. 2) and a plurality of closure fasteners 20 (FIG. 3) which may comprise fasteners selected from a group consisting of hook-loop closures, magnetic closures, magnetic tape, static closures and re-sealable adhesive closures; are integrated with the first side closure seam 16 (FIG. 3) and the second side closure seam 18 (FIG. 3) to maintain the first side closure seam 16 and the second side closure seam 18 in clinched positional alignment whereby which a self-closing vertical opening and horizontal opening is formed which completely envelopes the stringed musical instrument 1 (FIG. 4) while it is supported on an instrument stand 2.

In another embodiment the self-closing hooded cover for a stringed musical instrument 100 may further comprise a waterproof barrier affixed to the exterior surface 26 of the body 12 and hood 14 that may be of a material of construction selected from a group consisting of waterproof leather, vinyl, polyurethane, polyethylene, polyester, nylon and rubber, which has the capability to provide a contiguous waterproof panel that is impermeable to environmental elements, wherein such exposure would not be deleterious to the suppleness of the fabric layer of the fabric panel 30 to which it is attached.

In another embodiment, the self-closing hooded cover for a stringed musical instrument 100 may further comprise a clear pocket with flap of a material of construction selected from a group consisting of vinyl, polyester, polypropylene, acrylic or acetate, which is affixed to the rear exterior surface 26 of the body 12 in a predetermined location by any process known in the Textile Arts such as sewing, weaving, adhesive bonding, heat seaming and ultrasonic welding, that is suitable to provide the user the ability to display promotional graphics, identify their musical instrument 1 or to otherwise personalize the self-closing hooded cover for a stringed musical instrument 100 as the user dictates. In another embodiment, the self-closing hooded cover for a stringed musical instrument 100 may further comprise a pocket with flap constructed of a similar material as the fabric panel 30, which is selected from a group of textiles consisting of acrylic, cotton, polyester, rayon, ramie, nylon, silk, acetate, wool, bamboo, flax, polyester/cotton blends, wool/polyester blends, polyester/cotton/spandex blends, having feathered ends, woven to produce a supple and plush fabric layer that does not pill, lint or harm the finish of the stringed instrument 1, which may be affixed by any process known in the Textile Arts such as sewing, weaving, adhesive bonding, heat seaming and ultrasonic welding to the rear side 15 exterior surface 26 of the body 12 in a predetermined location that may provide the user additional storage for sheet music and accessories. In another embodiment, the self-closing hooded cover for a stringed musical instrument 100 may further comprise a pocket with flap of similar material of construction as the fabric panel 30, which is selected from a group of textiles consisting of acrylic, cotton, polyester, rayon, ramie, nylon, silk, acetate, wool, bamboo, flax, polyester/cotton blends, wool/polyester blends, polyester/cotton/spandex blends, having feathered ends, woven to produce a supple and plush fabric layer that does not pill, lint or harm the finish of the stringed instrument 1, which may be affixed by any process known in the Textile Arts such as sewing, weaving, adhesive bonding, heat seaming and ultrasonic welding to the rear 15 interior side 24 of the body 12 in a predetermined location that may provide the user additional storage for sheet music and accessories.

Figure 2:
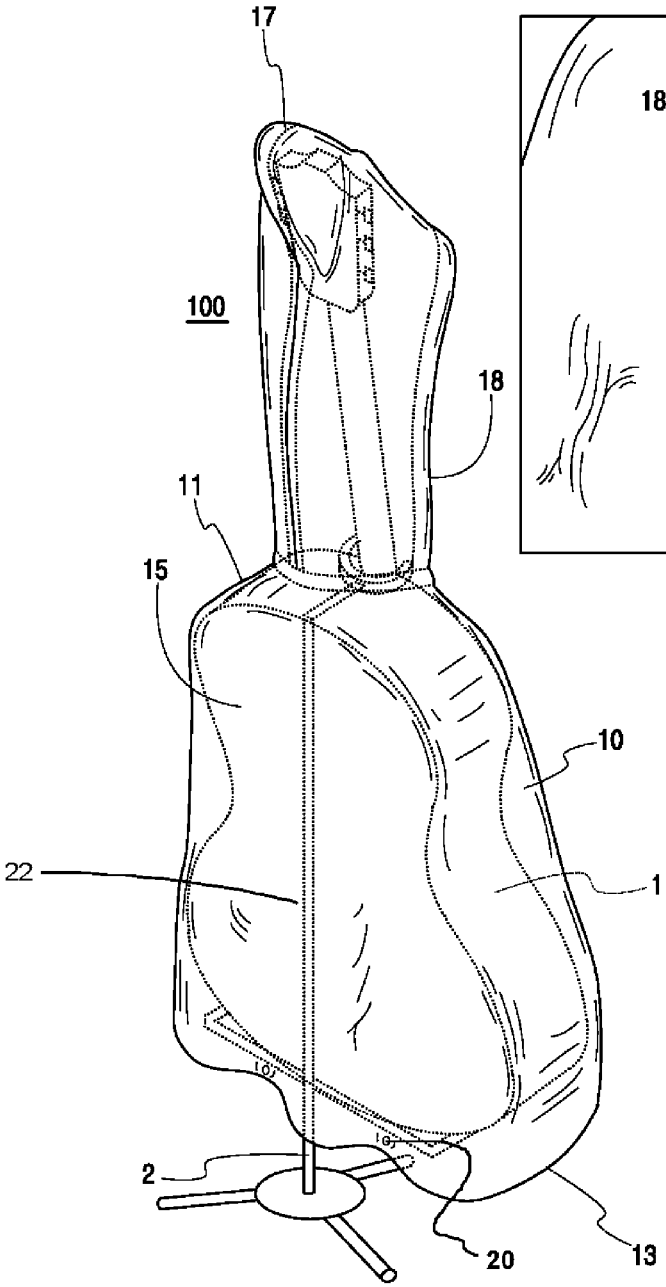
FIG. 2 is a drawing of the Self-Closing Hooded Cover for a Stringed Musical Instrument, showing a rear perspective view of the self-closing hooded cover for a stringed musical instrument covering a guitar supported upon an elevated stand, wherein only the hooded portion of the cover is left open; demonstrating the spatial relationship of the self-closing cover for a stringed instrument to the instrument stand and guitar (in phantom).

Referring to FIG. 2, a rear perspective view of the present embodiment of the Self-Closing Hooded Cover for a Stringed Musical Instrument is generally shown at 100. The Self-Closing Hooded Cover for a Stringed Musical Instrument 100 is positioned on a stringed musical instrument 1 that is supported on an instrument stand 2, wherein the hood 14 (FIG. 1) top side 17 is covering the head (or scroll) of the stringed musical instrument 1 such that the midline of the stringed musical instrument 1 is aligned with the midline 22 of the self-closing hooded cover for a stringed musical instrument 100. The hood 14 is shown with the second side closure seam 18 separated from the first side closure seam 16 (FIG. 1) creating an opening whereby the user has access to the neck of the stringed musical instrument 1. The stringed musical instrument 1 serves to pronounce the contours of the first side 10 and second side 11, which is a function of the fabric panel 30 (FIG. 1) characteristic textile properties of suppleness. The rear side 15 extends well beyond the back of the stringed musical instrument 1 such that the self-closing hooded cover for a stringed musical instrument 100 may completely envelope it and mitigate the exposure of dust, debris and other environmental elements.

Figure 3:
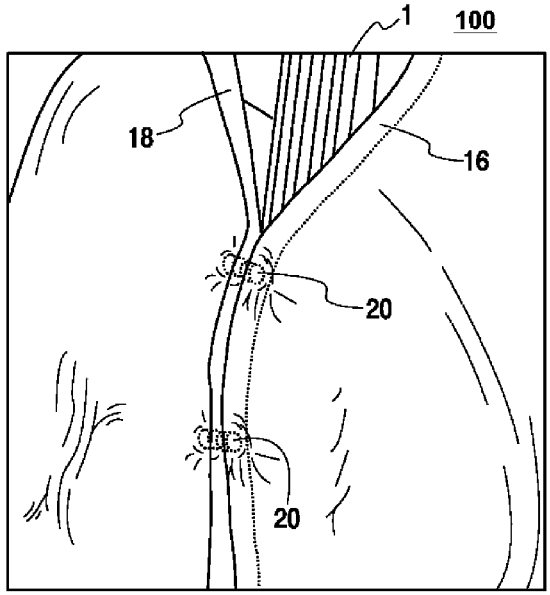
FIG. 3 is a drawing of an enlarged front section view of the Self-Closing Hooded Cover for a Stringed Musical Instrument neck area, wherein the first side closure seam and second side closure seam are joined in positional alignment by a series of magnetic closures to form a seal against environmental elements.

Referring to FIG. 3 a front sectional view of the present embodiment of the Self-Closing Hooded Cover for a Stringed Musical Instrument is generally shown at 100. The Self-Closing Hooded Cover for a Stringed Musical Instrument 100 is shown with the first side seam closure 16 and second side seam closure 18 in a partially open state, wherein the closure fasteners 20 are shown in positional agreement in the closed portion where the first side seam closure 16 and second side seam closure 18 are in contact, while the neck of the stringed musical instrument 1 is exposed through the opening created by the separation of the closure fasteners 20. In the present embodiment the closure fasteners 20 may be magnetic and incorporated into the interior surface 24 (FIG. 1) of the first side closure seam 16 and the second side closure seam 18 in symmetrical positional agreement such that when they are joined the hold the first side closure seam 16 and the second side closure seam 18 closed. In another embodiment the magnetic closure fasteners 20 may comprise at least one set of paired opposing miniature high magnetic flux magnets selected from a group consisting of aluminum-nickel-cobalt, neodymium, samarium-cobalt and strontium-ferrite ceramic, wherein a first miniature magnet of the pair is incorporated in a predetermined location within the first side closure seam 16 and a second miniature magnet of the pair is located incorporated in a predetermined location within the second side closure seam 16 which is in symmetrical positional agreement to the first miniature magnet. In another embodiment the magnetic closure fasteners 20 comprises at least one set of paired opposing flexible strip high magnetic flux magnets selected from a group consisting of aluminum-nickel-cobalt, neodymium, samarium-cobalt and strontium-ferrite ceramic, wherein a first flexible strip magnet of the pair are located in a predetermined location on the front 19 (FIG. 1) exterior surface 26 (FIG. 1) the first side closure seam 16 and a second flexible strip magnet of the pair is located in a predetermined location on the front 19 (FIG. 1) exterior surface 26 (FIG. 1) on the second side closure seam 18 which is symmetrical to the first flexible strip magnet. In another embodiment the magnetic closure fasteners 20 are incorporated onto the front 19 (FIG. 1) exterior surface 26 (FIG. 1) of the first side closure seam 16 and the second side closure seam 18 in symmetrical positional agreement. In another embodiment the magnetic closure fasteners 20 may comprise at least one set of paired opposing miniature high magnetic flux magnets selected from a group consisting of aluminum-nickel-cobalt, neodymium, samarium-cobalt and strontium-ferrite ceramic, wherein a first miniature magnet of the pair are located in a predetermined location on the front 19 (FIG. 1) exterior surface 26 (FIG. 1) the first side closure seam 16 and a second miniature magnet of the pair is located in a predetermined location on the front 19 (FIG. 1) exterior surface 26 (FIG. 1) on the second side closure seam 18 which is symmetrical to the first miniature magnet. In another embodiment the closure fasteners 20 may comprise at least one set of paired opposing hook-loop fasteners, wherein a first hook-loop fastener of the pair is located in a predetermined location on the front 19 (FIG. 1) exterior surface 26 (FIG. 1) of the first side closure seam 16 and a second hook-loop fastener of the pair is located in a predetermined location on the front 19 (FIG. 1) exterior surface 26 (FIG. 1) on the second side closure seam 18 which is symmetrical to the first hook-loop fastener and when they are joined the form a flap.

Figure 4:
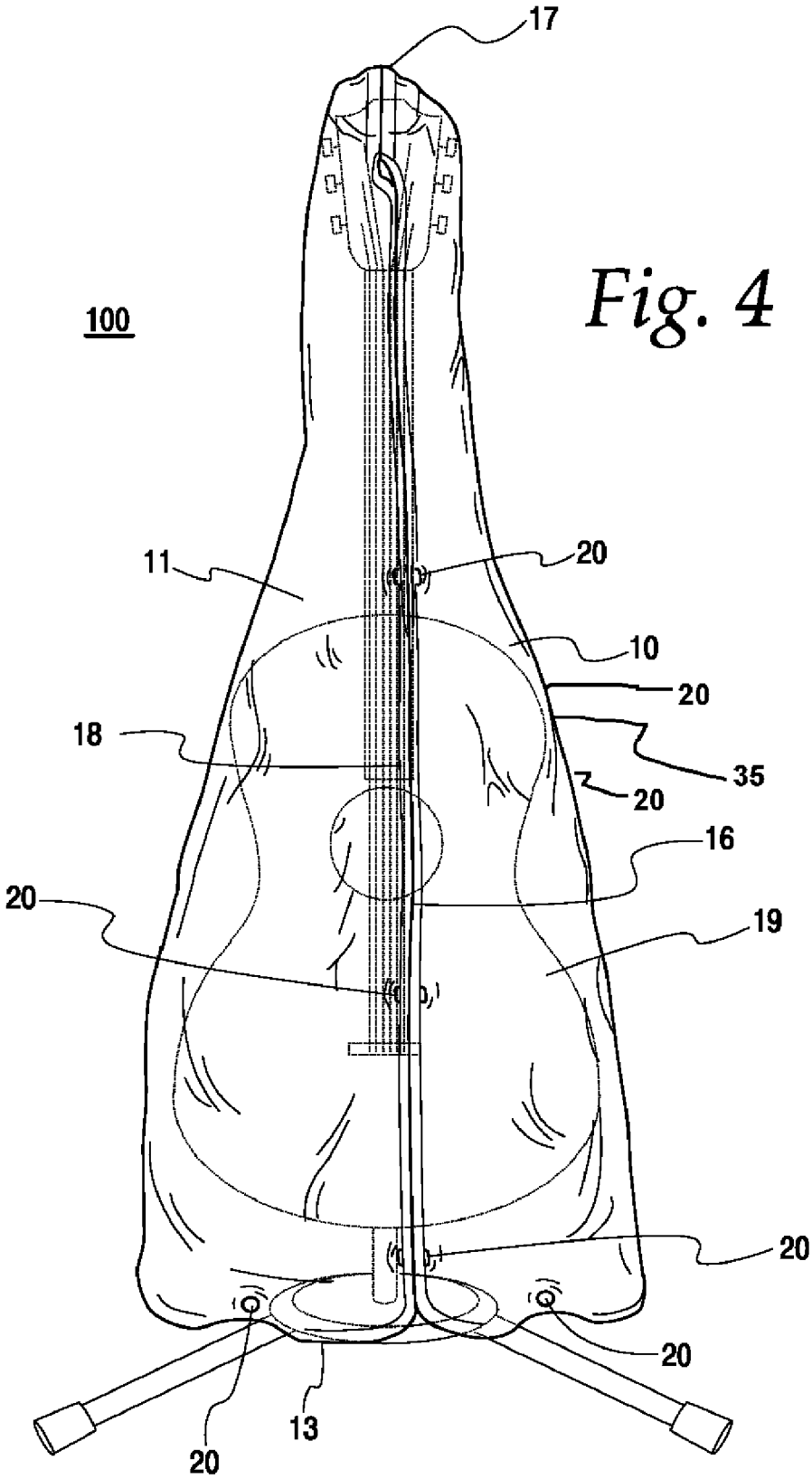
FIG. 4 is a drawing of the Self-Closing Hooded Cover for a Stringed Musical Instrument, showing a front elevational view of the self-closing hooded cover for a stringed musical instrument covering a guitar supported upon an elevated stand, wherein the hooded cover is completely closed; demonstrating the spatial relationship of the self-closing cover for a stringed instrument to the instrument stand and guitar (in phantom).

Referring to FIG. 4 a front elevational view of the present embodiment of the Self-Closing Hooded Cover for a Stringed Musical Instrument is generally shown at 100. The Self-Closing Hooded Cover for a Stringed Musical Instrument 100 is shown in the completely closed position while covering a stringed musical instrument 1 on a stand 2 with the first side seam closure 16 and second side seam closure 18 in a fully engaged state from the top 17 to the bottom 13. A plurality of closure fasteners 20 are shown in positional agreement in the closed portion throughout the range where the first side seam closure 16 and second side seam closure 18 are in contact. The opening at the bottom 13 is also secured by a plurality of closure fasteners 20 that are in symmetrical positional agreement on both the front 19 bottom side 13 and the rear 15 (FIG. 2) bottom side 13 (FIG. 2) which effectively acts to seal underneath the stringed musical instrument 1 while it is on a stand 2 and protect it from dust, debris and other environmental elements. In another embodiment the self-closing hooded cover for a stringed instrument 100 may further comprise at least one self-closing side slit 35 of a give length and width positioned in a predetermined location in either the first side plane and a second side plane formed by the self-closing hooded cover for a stringed instrument 100 when it is placed over a stringed instrument case and assumes the contour of the stringed instrument case first side plane and second side plane, whereby substantial alignment with the case handle is achieved. The self-closing side slit 35 having a plurality of closure fasteners 20 about the length of the self-closing side slit 35 in positional agreement along the edges to maintain the self-closing side slit 35 in closed position.

Turning again to FIG. 1 the proposed method of use of the self-closing hooded cover for stringed musical instrument 100 may consist of the following sequence wherein an individual user or musician (typ.) is desires to cover the instrument 1 that is resting on a stand 2:

6. The musician removes the self-closing hooded cover for a stringed instrument 100 from its stowed position and unfolds and extends the self-closing hooded cover for a stringed musical instrument 100 to its full length.
7. The musician then opens the self-closing hooded cover for a stringed instrument 100 by disengaging the closure fasteners 20 from the first and second side closure seams 16, 18 (respectively) traversing the entire midline 22 and bottom side 13 of the self-closing hooded cover for a stringed musical instrument 100.

8. The musician then drapes the self-closing hooded cover for a stringed musical instrument 100 over the head (or scroll) of the stringed instrument 1, wherein the first and second side closure seams 16, 18 (respectively) are in approximate positional agreement with the midline of the front side of the instrument 1. In the instance where the stringed instrument 1 is to be hung from a wall hanger, the musician then drapes the self-closing hooded cover for a stringed instrument 100 over the head (or scroll) of the stringed instrument 1, wherein the first and second side closure seams 16, 18 (respectively) are in approximate positional agreement with the midline of the back side of the instrument 1.
9. The musician then grasps the bottom front of the first and second side closure seams 16, 18 (respectively) and tensionably aligns the closure fasteners 20 (FIG. 4) located in the bottom 13 front 19 closure seam with the closure fasteners 20 located in the bottom 13 rear 15 closure seam.
10. The musician may then open the self-closing hooded cover for a stringed instrument 100 to whatever extent desired by opening closure fasteners 20 about the closure seam, separating the first and second closure seams 16, 18 (respectively) to create an opening of desirable length.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

APPENDIX TO SPECIFICATION

List of Numerals

| | |
|---|---|
| 100 | SELF-CLOSING HOODED COVER FOR STRINGED INSTRUMENT |
| 1 | STRINGED INSTRUMENT (GUITAR) |
| 2 | INSTRUMENT STAND |
| 10 | FIRST SIDE |
| 11 | SECOND SIDE |
| 12 | BODY ELEMENT |
| 13 | BOTTOM SIDE |
| 14 | HOOD ELEMENT |
| 15 | REAR SIDE |
| 16 | FIRST SIDE CLOSURE SEAM |
| 17 | TOP SIDE |
| 18 | SECOND SIDE CLOSURE SEAM |
| 19 | FRONT SIDE |
| 20 | CLOSURE FASTENERS |
| 22 | MIDLINE |
| 24 | INTERIOR SURFACE |
| 26 | EXTERIOR SURFACE |
| 30 | FABRIC PANEL |
| 35 | SELF-CLOSING SIDE SLIT |

What is claimed is:

1. A self-closing hooded cover for a stringed instrument comprising:

at least one fabric panel of a material of construction comprising at least one fabric layer of a predetermined size and shape that substantially approximates a given stringed musical instrument, whereby said fabric panel has a first side, a second side, a top side a bottom side, an interior surface and an exterior surface, which is contoured to form a symmetrical joined hood and body element, and the joined hood and body element having a first side, a second side a top side, a bottom side, a front side and a rear side, whereby a first side closure seam formed by folding a predetermined length of the fabric panel exterior surface over the fabric panel interior surface and joining these surfaces from the midline of the hood top first side to the midline of the body rear side; a second side closure seam formed by folding a predetermined length of the fabric panel exterior surface over the fabric panel interior surface and joining these surfaces from the midline of the hood top second side to the midline of the body rear side, and a plurality of closure fasteners which are integrated with the first side closure seam and the second side closure seam to maintain the first side closure seam and the second side closure seam in clinched positional alignment whereby which a self-closing vertical opening and horizontal opening is formed which completely envelopes the stringed musical instrument, a plurality of fasteners that are in symmetrical positional agreement on both the front bottom side and rear bottom side which effectively acts to seal underneath the stringed musical instrument while it is on a stand from dust, debris and other environmental elements, and at least one self-closing side slit of a given length and width positioned in a predetermined location having a plurality of closure fasteners about the length of the self-closing side slit in positional agreement along the edges to maintain the self-closing side slit in closed position, into one of either the first side plane and a second side plane respectively formed by the self-closing hooded cover for a stringed instrument assuming the contour of the stringed instrument case first side plane and second side plane, whereby substantial alignment with the case handle is achieved.

2. The self-closing hooded cover for a stringed musical instrument of claim 1 wherein the fabric layer of the fabric panel further comprises a material of construction selected from a group of textiles consisting of acrylic, cotton, polyester, rayon, ramie, nylon, silk, acetate, wool, bamboo, flax, polyester/cotton blends, wool/polyester blends, polyester/cotton/spandex blends, having feathered ends, woven to produce a supple and plush fabric layer that does not pill, lint or harm the finish of the stringed instrument.

3. The self-closing hooded cover for a stringed musical instrument of claim 1, wherein the fabric layer of the fabric panel further comprises a waterproof barrier affixed to the exterior surface of said fabric panel comprising at least one material of construction selected from a group consisting of waterproof leather, vinyl, polyurethane, polyethylene, polyester, nylon and rubber, which is capable of providing a contiguous waterproof panel and being impermeable to environmental elements wherein such exposure would not be deleterious to the suppleness commensurate of the fabric layer, to which it is attached.

4. The self-closing hooded cover for a stringed musical instrument of claim 1, wherein the closure fasteners further comprise fasteners selected from a group consisting of snap-hook closures, magnetic closures, magnetic tape, static closures and re-sealable adhesive closures.

5. The self-closing hooded cover for a stringed musical instrument of claim 1 wherein magnetic closure fasteners are incorporated into the interior surface of the first side closure seam and the second side closure seam in symmetrical positional agreement.

6. The self-closing hooded cover for a stringed musical instrument of claim 1, wherein the magnetic closure fasteners comprise at least one set of paired opposing miniature high magnetic flux magnets selected from a group consisting of aluminum-nickel-cobalt, neodymium, samarium-cobalt and strontium-ferrite ceramic, wherein a first miniature magnet of the pair is incorporated in a predetermined location within the first side closure seam and a second miniature magnet of the pair is located incorporated in a predetermined location within the second side closure seam which is symmetrical to the first miniature magnet.

7. The self-closing hooded cover for a stringed musical instrument of claim 1, wherein the magnetic closure fasteners comprise at least one set of paired opposing flexible strip high magnetic flux magnets selected from a group consisting of aluminum-nickel-cobalt, neodymium, samarium-cobalt and strontium-ferrite ceramic, wherein a first flexible strip magnet of the pair are located in a predetermined location on the front exterior surface the first side closure seam and a second flexible strip magnet of the pair is located in a predetermined location on the front exterior surface on the second side closure seam which is symmetrical to the first flexible strip magnet.

8. The self-closing hooded cover for a stringed musical instrument of claim 1 wherein magnetic closure fasteners are incorporated onto the front exterior surface of the first side closure seam and the second side closure seam in symmetrical positional agreement.

9. The self-closing hooded cover for a stringed musical instrument of claim 1, wherein the magnetic closure fasteners comprise at least one set of paired opposing miniature high magnetic flux magnets selected from a group consisting of aluminum-nickel-cobalt, neodymium, samarium-cobalt and strontium-ferrite ceramic, wherein a first miniature magnet of the pair are located in a predetermined location on the front exterior surface the first side closure seam and a second miniature magnet of the pair is located in a predetermined location on the front exterior surface on the second side closure seam which is symmetrical to the first miniature magnet.

10. The self-closing hooded cover for a stringed musical instrument of claim 1, wherein the closure fasteners comprise at least one set of paired opposing hook-loop fasteners, wherein a first hook-loop fastener of the pair is located in a predetermined location on the front exterior surface the first side closure seam and a second hook-loop fastener of the pair is located in a predetermined location on the front exterior surface on the second side closure seam which is symmetrical to the first hook-loop fastener, which join to create a flap.

11. The self-closing hooded cover for a stringed instrument of claim 1 further comprising a clear pocket with flap of a material of construction selected from a group consisting of vinyl, polyester, polypropylene, acrylic or acetate, which is affixed to the rear exterior surface of the body element in a predetermined location.

12. The self-closing hooded cover for a stringed instrument of claim 1 further comprising a pocket with flap of a like material of construction selected from a group of textiles consisting of acrylic, cotton, polyester, rayon, ramie, nylon, silk, acetate, wool, bamboo, flax, polyester/cotton blends, polyester/cotton/spandex blends, wool/polyester blends, having feathered ends, woven to produce a supple and plush fabric layer that does not pill, lint or harm the finish of the stringed instrument, which is affixed to the rear exterior surface of the body element in a predetermined location.

13. The self-closing hooded cover for a stringed instrument of claim 1 further comprising a pocket with flap of a like material of construction selected from a group of textiles consisting of acrylic, cotton, polyester, rayon, ramie, nylon, silk, acetate, wool, bamboo, flax, polyester/cotton blends, polyester/cotton/spandex blends, wool/polyester blends, having feathered ends, woven to produce a supple and plush fabric layer that does not pill, lint or harm the finish of the stringed instrument, which is affixed to the rear interior surface of the body element in a predetermined location.

* * * * *